US006161976A

United States Patent [19]

Liu

[11] Patent Number: 6,161,976

[45] Date of Patent: Dec. 19, 2000

[54] AUTOMATIC WRITING APPARATUS FOR SEGMENTAL WRITING ELEMENTS WITH CAPS

[75] Inventor: Bao-Shen Liu, Taipei, Taiwan

[73] Assignee: Pioneer Industrial Corporation, Taipei, Taiwan

[21] Appl. No.: 09/324,406

[22] Filed: Jun. 2, 1999

[51] Int. Cl.[7] ..... B43K 21/14

[52] U.S. Cl. ..... 401/57; 401/89; 401/90

[58] Field of Search ..... 401/57, 103, 104, 401/89, 90

[56] References Cited

U.S. PATENT DOCUMENTS 3,790,291 2/1974 Hung et al. ..... 401/57
3,898,009 8/1975 Christensen ..... 401/57
4,551,034 11/1985 Zepell ..... 401/104
5,292,202 3/1994 Lee ..... 401/57

*Primary Examiner*—David J. Walczak
*Attorney, Agent, or Firm*—Fay, Sharpe, Fagan, Minnich & McKee, LLP

[57] ABSTRACT

An automatic writing apparatus includes a plurality of writing elements axially positioned one by one, each of which has a tip portion at the front end and an element cap having a hole for receiving therein the tip portion of an adjacent one of the writing elements; an outer tube for receiving therein a first and a second ones of the writing elements, wherein the outer tube includes a pen-tip outlet for holding the first one of the writing elements; and an inner tube for receiving therein the others of the writing elements and propelling the second one of the writing elements toward the pen-tip outlet for replacing the first one of the writing elements.

16 Claims, 9 Drawing Sheets

AUTOMATIC WRITING APPARATUS FOR SEGMENTAL WRITING ELEMENTS WITH CAPS

FIELD OF THE INVENTION

The present invention relates to a writing apparatus, and more particularly to an automatic writing apparatus for capped writing elements.

BACKGROUND OF THE INVENTION

A conventional automatic pencil has a very thin writing element, which is often broken during writing. Furthermore, a conventional automatic pencil usually has a metal pen-tip tube, which may tear the paper due to careless writing. These defects can be avoided by using a capped writing element pencil. The capped writing element pencil includes several axial-posited writing elements stored within a casing tube. Each of the writing elements includes a pre-sharpened writing element held by an element cap. The element cap includes a hole at its rear portion to receive the tip portion of the next writing element. When the front-most writing element is blunt or broken, it must be detached from the front opening of the casing tube and inserted into the casing tube from the rear opening of the casing tube. Unfortunately, the replacing operation is executed manually. Accordingly, it is desirable to develop an automatic capped writing element writing apparatus.

Furthermore, the pen tip of the conventional capped writing element pencil is not retractable, so a tip-cap is needed to protect the pen tip. If the tip-cap is lost, the pen tip cannot be protected anymore.

SUMMARY OF THE INVENTION

An object of the present invention is to provide an automatic capped writing element pencil.

Another object of the present invention is to provide a capped writing element pencil with retractable pen tip.

According to the present invention, an automatic capped writing element writing apparatus is provided. The apparatus includes a plurality of writing elements axially positioned one by one. Each of the elements has a tip portion at the front end and an element cap having a hole for receiving therein the tip portion of an adjacent one of the writing elements. The apparatus further includes an outer tube for receiving therein first and second writing elements. The outer tube includes a pen-tip outlet for receiving the first one of the writing elements. The apparatus further includes an inner tube for receiving therein the others of the writing elements and propelling the second one of the writing elements toward the pen-tip outlet for replacing the first one of the writing elements.

The inner tube preferably includes an end opening for engaging with the element cap of the second one of writing elements and allowing a third one of the writing elements to fall into the outer tube from the inner tube. The rim of the lead cap is preferably sharpened for properly engaging with the end opening of the inner tube when being propelled. Furthermore, the rim of the end opening is preferably saw-toothed for properly engaging with the element cap of the second one of the writing elements when propelling the second one of the writing elements.

Preferably, the upper end of the inner tube is exposed from the outer tube for being pressed by a user to propel the second one of the writing elements. The apparatus preferably further includes a resilient element for keeping the inner tube in an original position when the inner tube is not pressed. The resilient element is preferably a spring sleeved on the inner tube.

In accordance with another aspect of the present invention, the pen tip of the apparatus is retractable. The apparatus preferably further includes a locking mechanism for maintaining the inner tube in a lower position when the second one of the writing elements has been propelled to replace the first one of the writing elements.

Preferably, the locking mechanism includes a flexible piece mounted on the outer wall of the inner tube. The locking mechanism further includes an opening formed on the outer tube so that when the inner tube is in the lower position, the flexible piece is stuck at the opening for preventing the inner tube from being urged back by the resilient element to the original position.

The apparatus preferably further comprising a clip mounted on the outer tube, wherein the clip includes a raised portion facing the opening of the outer tube so that the flexible piece is pushed away from the opening when the clip is pressed. An article is preferably against the tip portion of the second one of the writing elements when the flexible piece is pushed away from the opening so that the second one of the writing elements is pushed back into the outer tube by the article to retract the second one of the writing elements.

The apparatus preferably further includes a raised structure formed on the inner wall of the outer tube for maintaining the tip portion of the second one of the writing elements within the outer tube when being retracted.

The present invention may best be understood through the following description with reference to the accompanying drawings, in which:

BRIEF DESCRIPTION OF THE DRAWINGS

FIG. 14(*a*) is a cross sectional view of FIG. 14 alone the line a–a1;

DETAILED DESCRIPTION OF THE PREFERRED EMBODIMENTS

Figure 1:
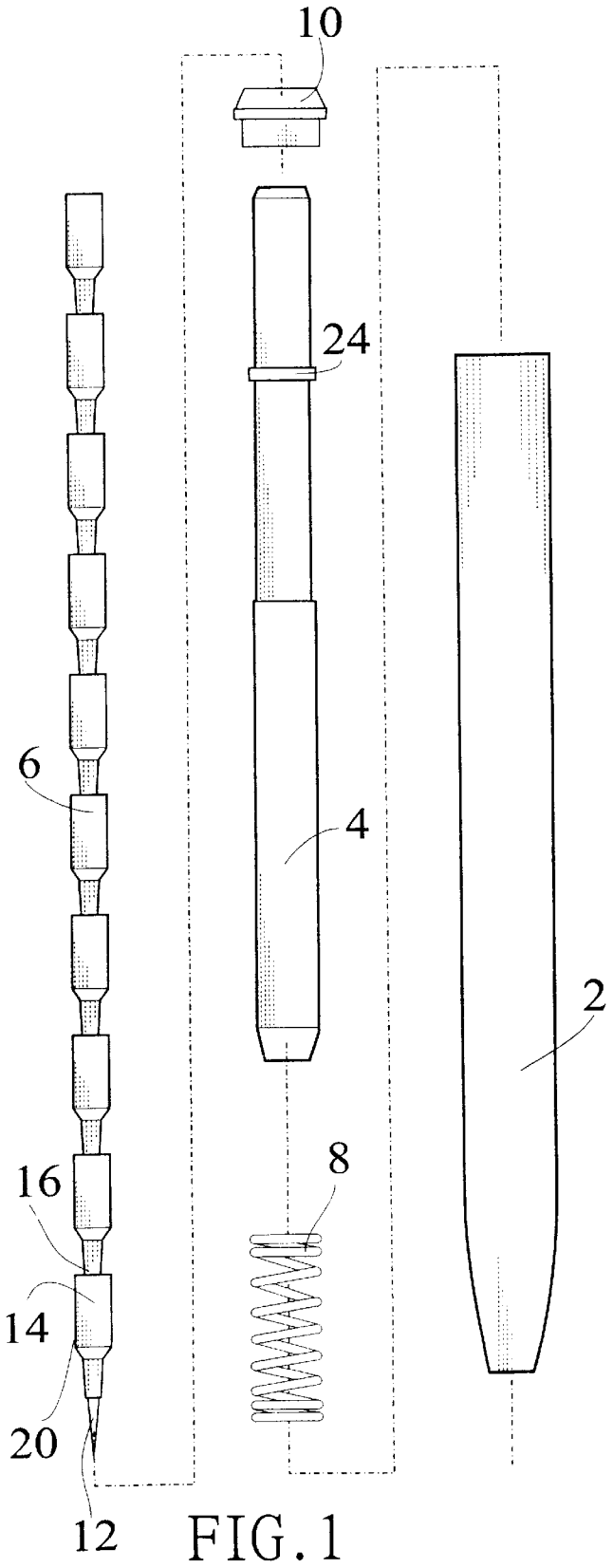
FIG. 1 is an exploded view of an automatic capped writing element pencil according to the present invention.
Figure 2:
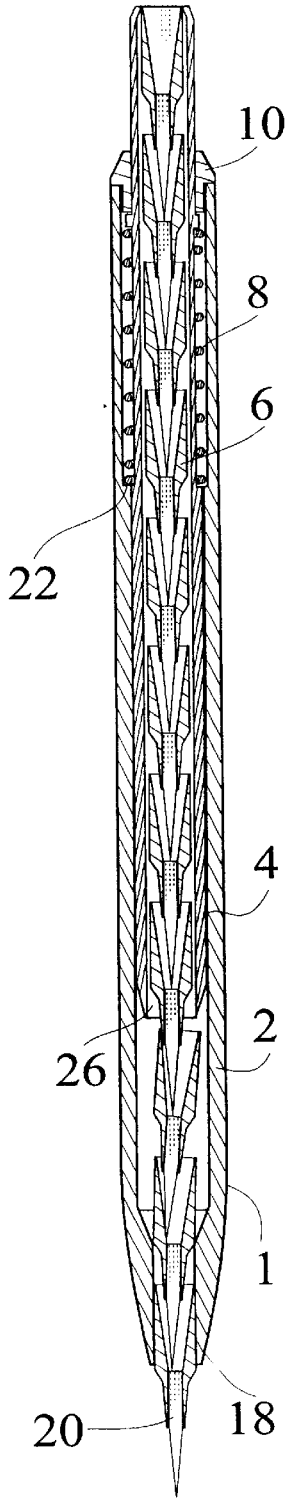
FIG. 2 illustrates the assembled automatic capped writing element pencil of FIG. 1.

As shown in FIGS. 1 and 2, the automatic capped writing element pencil 1 includes an outer tube 2, an inner tube 4, writing elements 6, a spring 8, and a fixer 10. Each of the writing elements 6 has a tip portion 12 at the front end and an element cap 14 having a hole 16 for receiving therein the tip portion 12 of the adjacent writing element. The tip portion 12 is a pre-sharpened writing element held by the element cap 14. The writing element can be a pre-sharpened lead, a pre-sharpened crayon, or other segmental writing elements. The element cap 14 is made of plastic or metal. All the writing elements are positioned axially one by one. Except the front-most one, the tip portion 12 of each writing element is received by the hole 16 of the preceding one. The front-most writing element 20 is held by the writing element outlet 18 of the outer tube 2. Some of the writing elements 6 together with the inner tube 4 are posited in the outer tube 2. The spring 8 serves as the resilient element for keeping the inner tube 4 in an original position when the inner tube is not pressed. The other writing elements are stored in the inner tube 4. A recess portion 22 is formed on the inner wall of the outer tube 2 to receive the spring 8. A raised portion 24 is formed on the outer surface of the inner tube 4 for compressing the spring 8. The stopper 10 is mounted at the upper end of the outer tube 2 for preventing the inner tube 4 from escaping from the outer tube 2.

Figure 3:
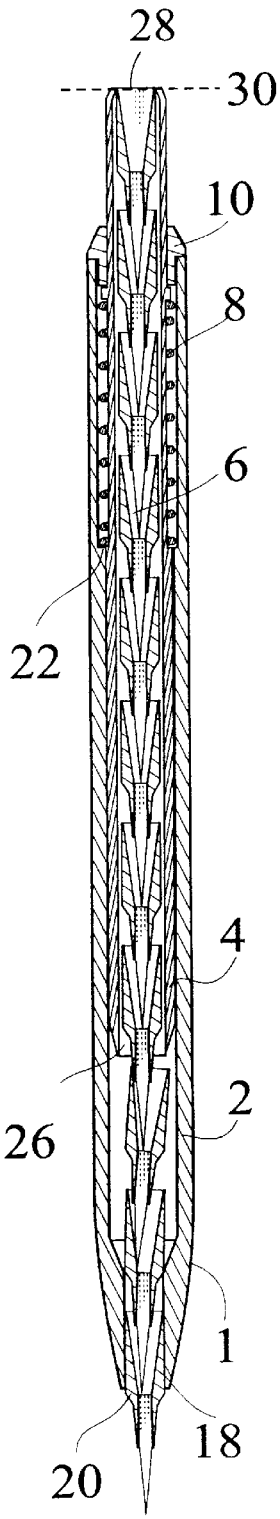
FIGS. 3–6 illustrate the operation of the automatic capped writing element pencil of FIG. 2.
Figure 4:
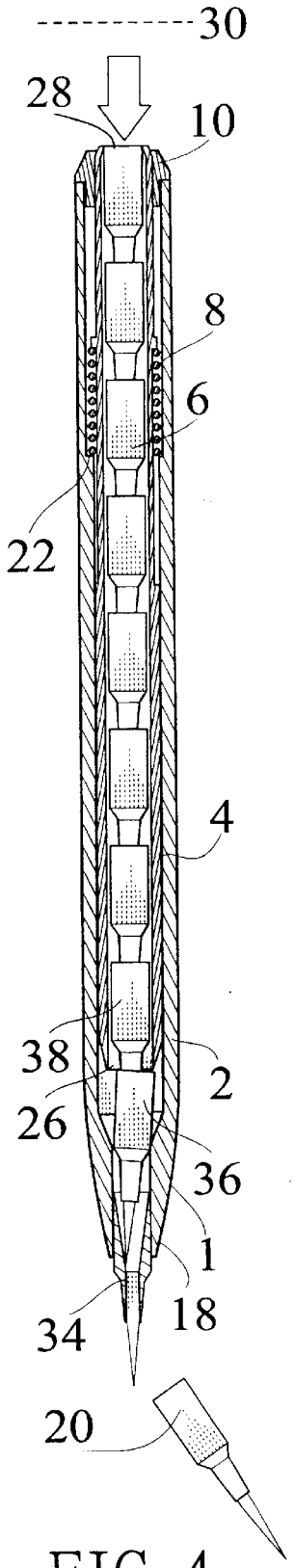
Figure 5:
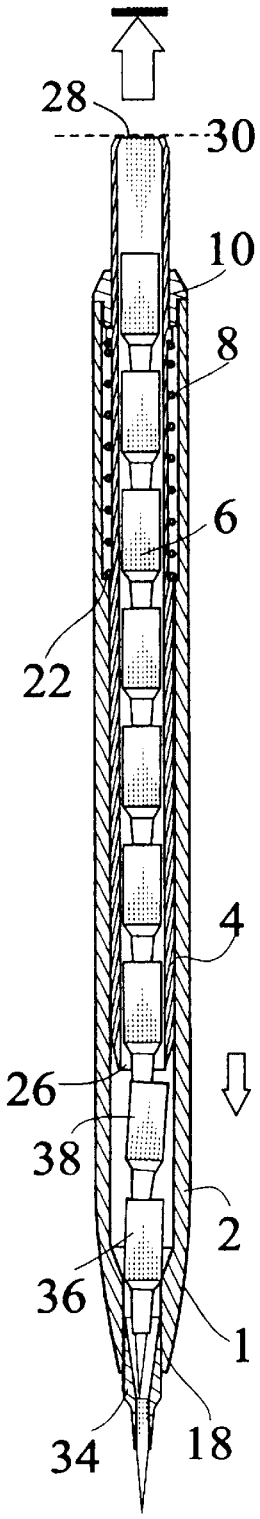
Figure 6:
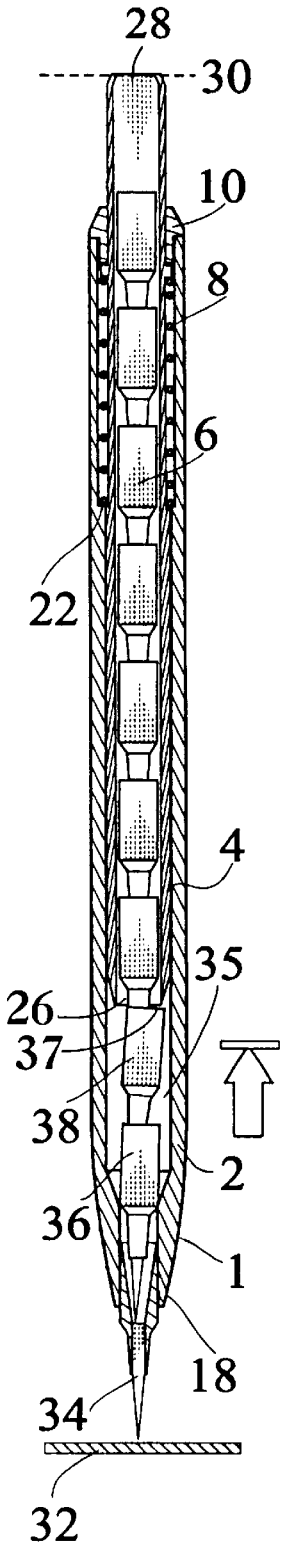

The operation of the automatic capped writing element apparatus 1 is illustrated in FIGS. 3–6. At the beginning, as shown in FIG. 3, the spring 8 is not compressed and the inner tube 4 is in an original position 30. Then, as shown in FIG. 4, the inner tube 4 is pushed from the top 28 to propel the writing element 36. The bottom opening 26 of the inner tube 4 is engaged with the element cap of the writing element 36. The writing elements 34 and 20 are also propelled by the writing element 36. The writing element 20 held by the writing element-outlet is then replaced by the writing element 34. The spring 8 is compressed by the raised portion 24 during the propelling process. When the inner tube 4 is released from the propelling force, as shown in FIG. 5, the spring force generated by the spring 8 will urge the inner tube toward the original position 30. However, because of gravity, the writing elements stored in the inner tube 4 will not be back to their original positions and the writing element 38 will escape from the bottom opening 26 to the bore 35 of the outer tube 2. FIG. 6 illustrates that the automatic capped writing element pencil 1 is used on an article 32. Because the element cap 37 of the writing element 38 is engaged with the bottom opening 26 of the inner tube, the writing element 34 which serving as the pen-tip will not be pushed back into the writing element-outlet 18.

Figure 7:
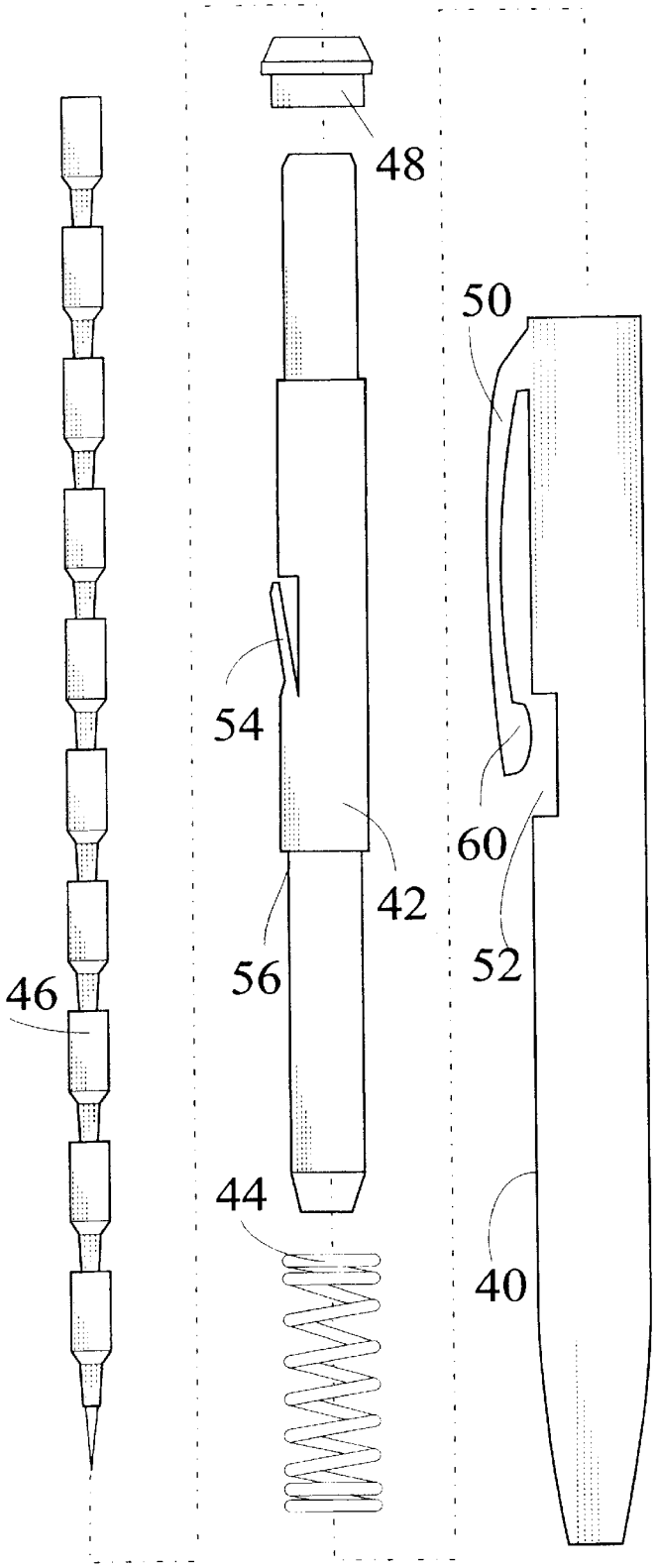
FIG. 7 is an exploded view of another automatic capped writing element pencil with retractable pen tip according to the present invention.
Figure 8:
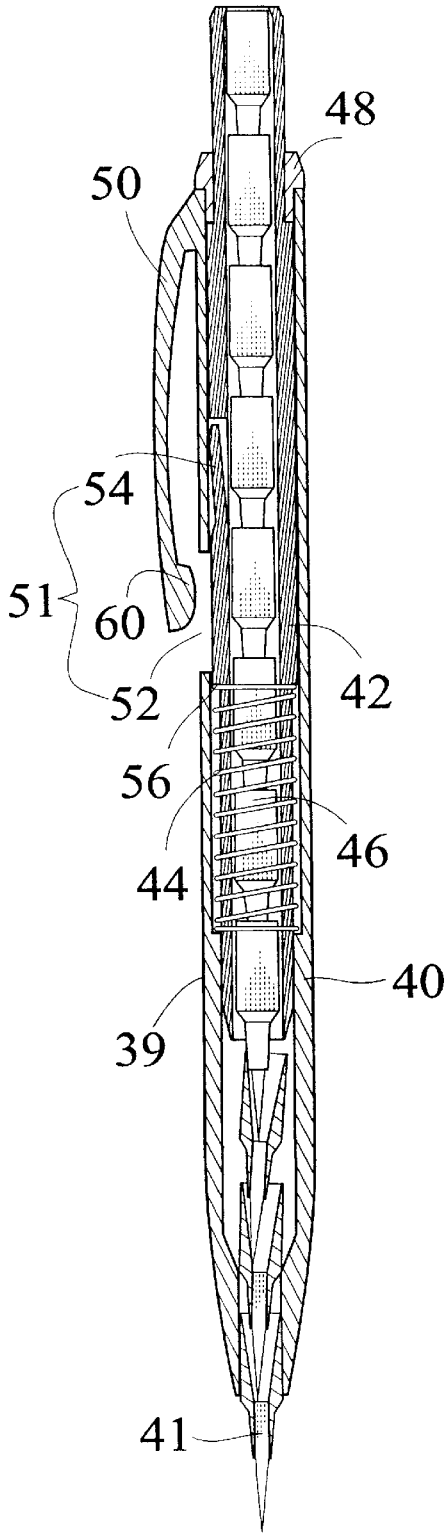
FIG. 8 illustrates the assembled automatic capped writing element pencil of FIG. 7.

FIGS. 7 and 8 illustrate an automatic capped writing element pencil 39 with retractable pen tip 41. Similar to the automatic capped writing element apparatus 1, the automatic capped writing element pencil 39 also includes an outer tube 40, an inner tube 42, writing elements 46, a spring 44, and a fixer 48. However, the automatic capped writing element pencil 39 further includes a locking mechanism 51 for fixing the inner tube 42 in a lower position when it is pressed. The locking mechanism 51 includes an opening 52 formed on the outer tube 40 and a flexible piece 54 formed on the inner tube 42. When the inner tube 42 is in an original position, the flexible piece 54 is located above the opening 52 and is compressed by the inner wall of the outer tube 40. When the inner tube 42 is pressed, the flexible piece 54 will raise from the opening 52 of the outer tube 40. The outer tube further includes a clip 50. The clip 50 has a tip portion 60 raised toward the opening 52.

Figure 9:
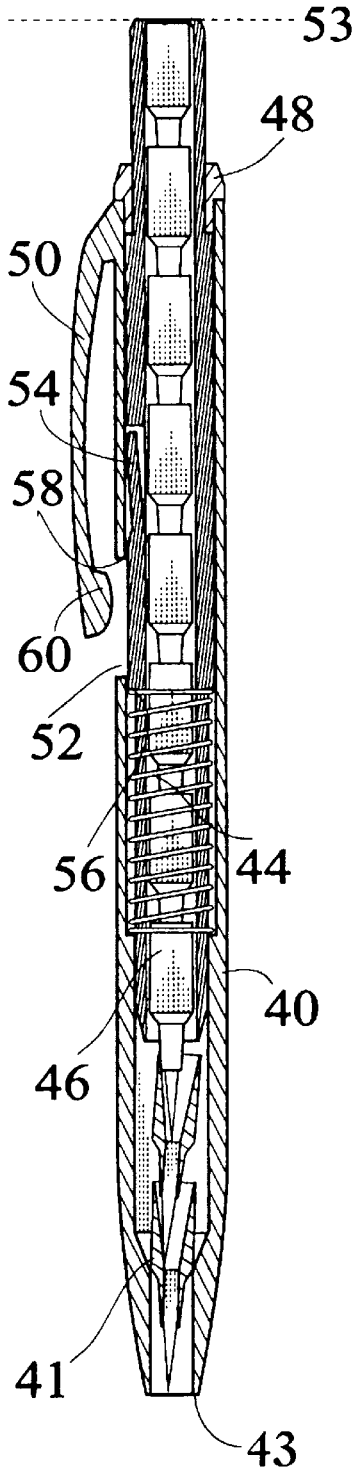
FIGS. 9–12 illustrates the operation of the automatic capped writing element pencil of FIG. 8.
Figure 10:
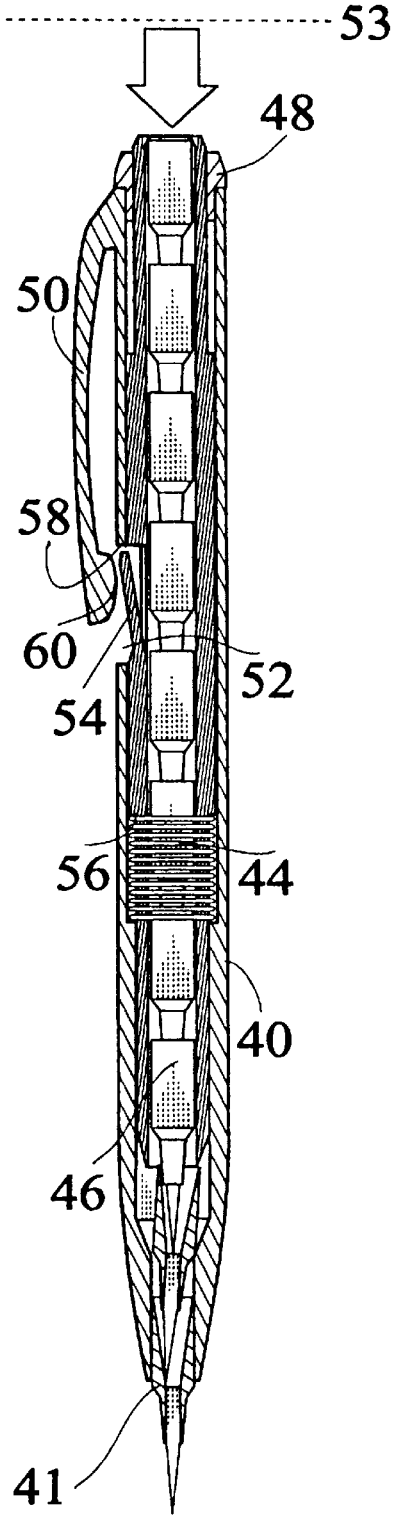
Figure 11:
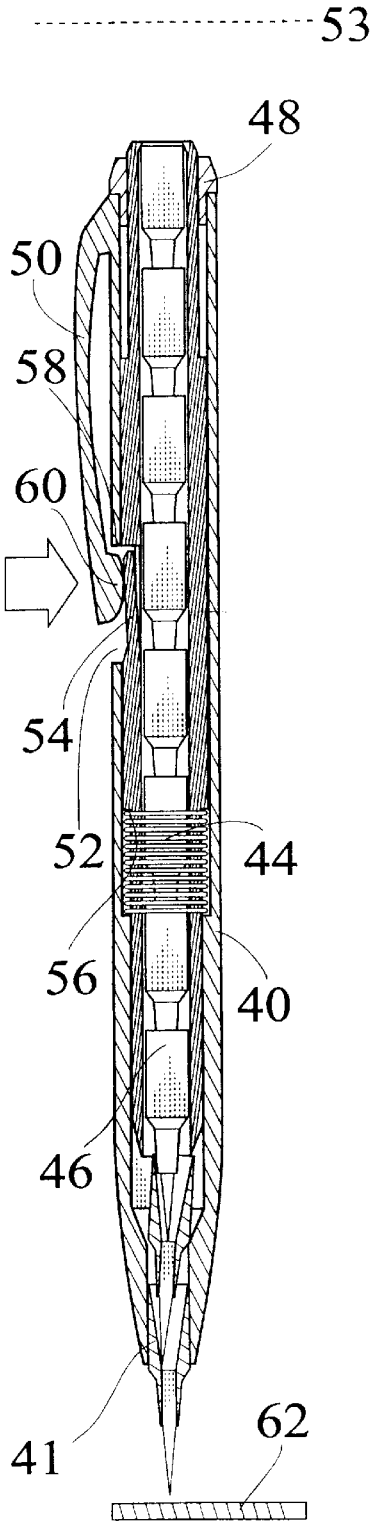
Figure 12:
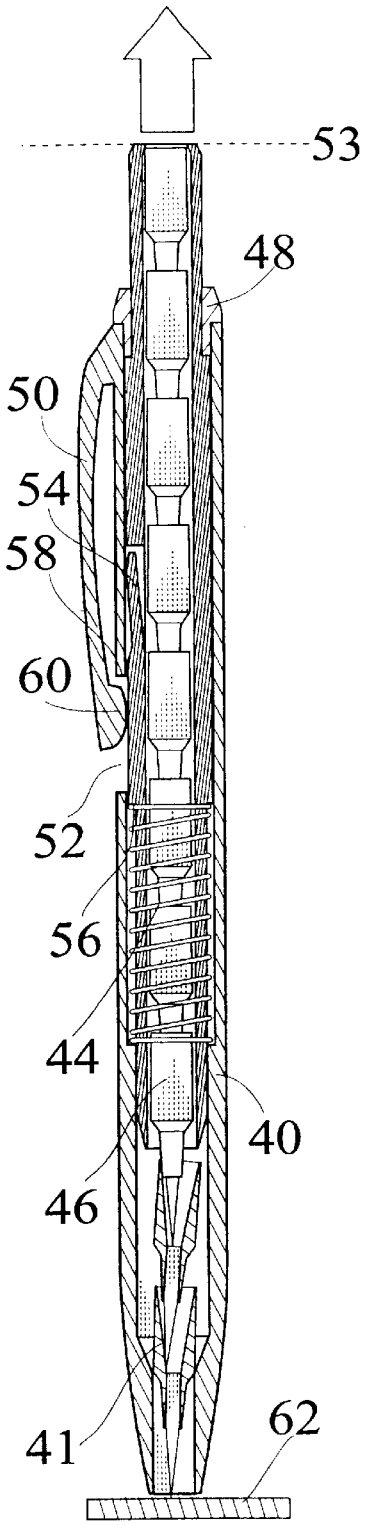

The operation of the automatic capped writing element pencil 39 is illustrated in FIGS. 9–12. FIG. 9 shows that the pen-tip writing element 41 is retracted within the writing element outlet 43 and the flexible piece 54 is located above the opening 52. When the inner tube 42 is pressed, the pen-tip writing element 41 is propelled to the writing element outlet 43 and held by it. The flexible piece 54 is moved to the opening 52 and raises up since it is not limited by the outer tube 40. Furthermore, the spring 44 is compressed during the propelling process. When the inner tube is released from the propelling force, the spring 44 will urge the raised portion of the inner tube 42 upwardly. However, as shown in FIG. 10, since the flexible piece 54 extends into the opening 52, it will be engaged at the upper edge 58 of the opening 52 to prevent the inner tube 54 from returning back to the original position. To retract the pen-tip writing element 41 again, the user just has to put the pen-tip writing element 41 on an article 62 and press the tip portion 60 of the clip 50. The flexible piece 54 is then compressed by the tip portion 60 and will no longer be engaged at the upper edge 58. Accordingly, the inner tube 42 is pushed by the spring 44 to return back to the original position 53. At the same time, the pen-tip writing element 41 is pushed by the article 62 to be retracted within the outer tube 40.

Figure 13:
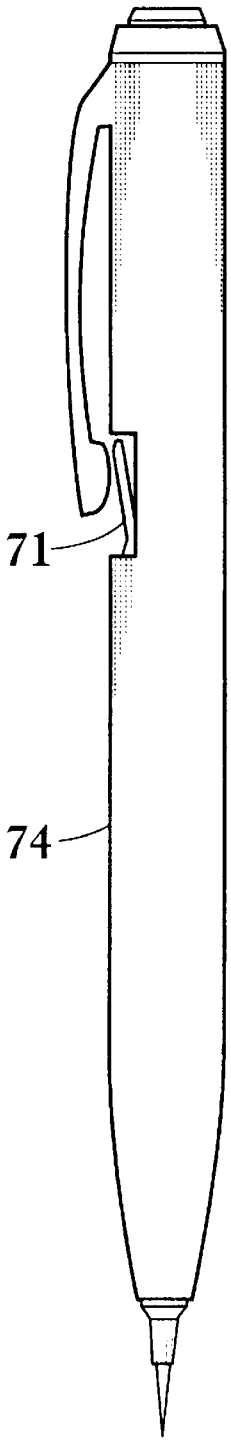
FIG. 13 illustrates an appearance of another automatic capped writing element pencil according to the present invention.
Figure 14A:
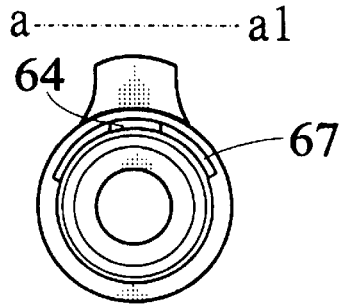
FIG. 14 illustrates a locking mechanism of an automatic capped writing element pencil with retractable pen tip according to the present invention.
Figure 14:
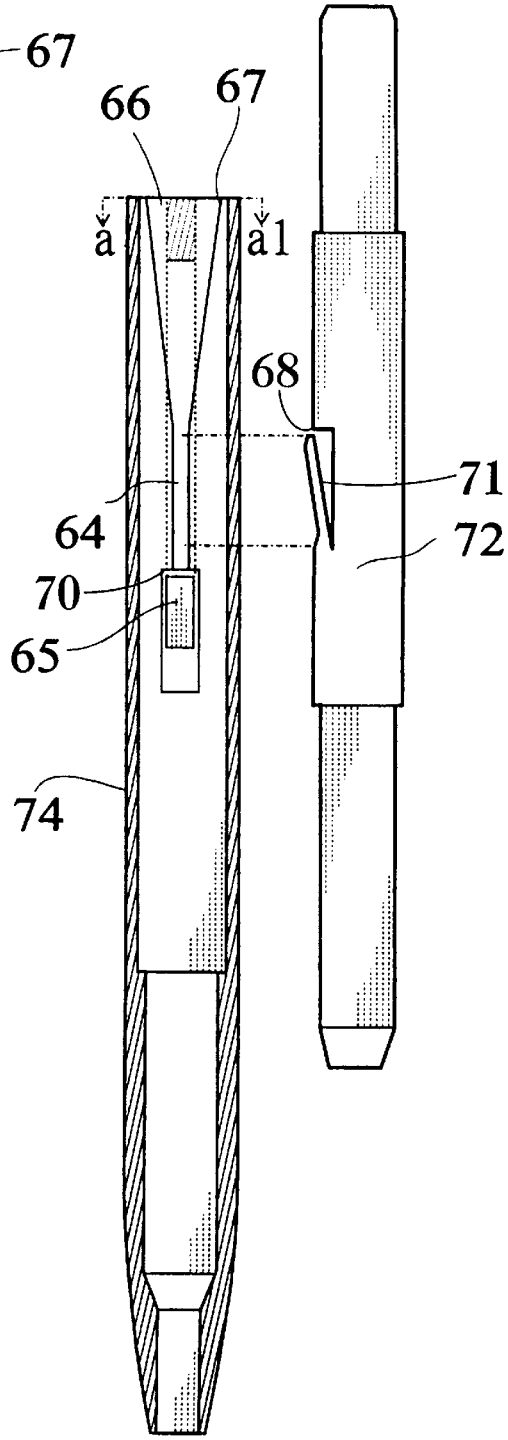

FIG. 13 illustrates the appearance of the automatic capped writing element pencil. For guiding the flexible piece 71 of the inner tube 72, as shown in FIGS. 13 and 14, a guiding slot 64 is formed on the casing tube 74 from the opening 65 to the rear end 66 of the casing tube 74. The entrance of the guiding slot 64 formed on the rear end 66 is enlarged to make the assembling of the casing tube 74 and the inner tube 72 easier. The flexible piece 71 can be inserted from the enlarged entrance 67 to the slot 64 very easily and the trouble of aligning the flexible piece 71 and the guiding slot 64 is avoided. Furthermore, a surface 70 corresponding to the front surface 68 of the inner tube 72 is formed on the inner wall of the outer tube 74 to serve as an end point of the propelling process of the inner tube 72.

Figure 15:
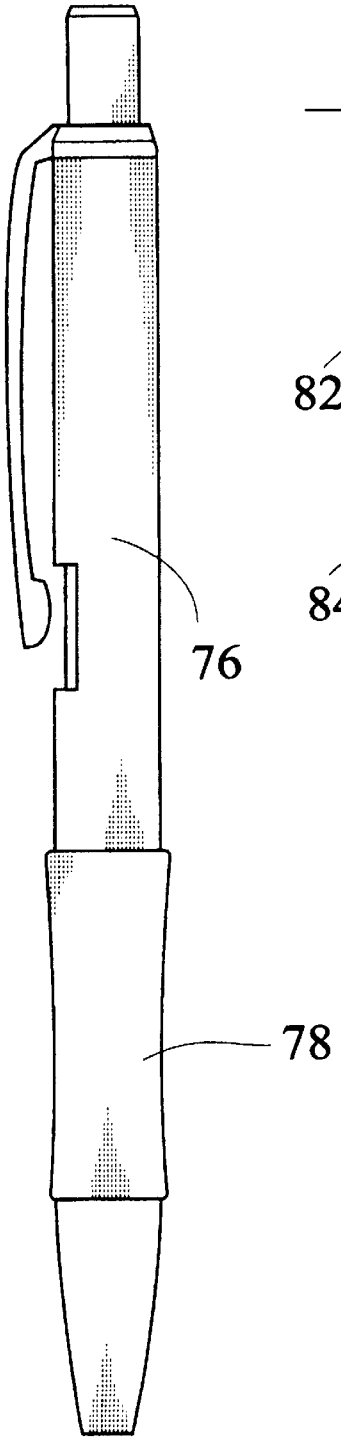
FIG. 15 shows another automatic capped writing element pencil according to the present invention.

FIG. 15 illustrates that a curved portion 78 is formed on the casing tube 76 for helping the user to grasp the casing tube 76 more properly.

Figure 16:
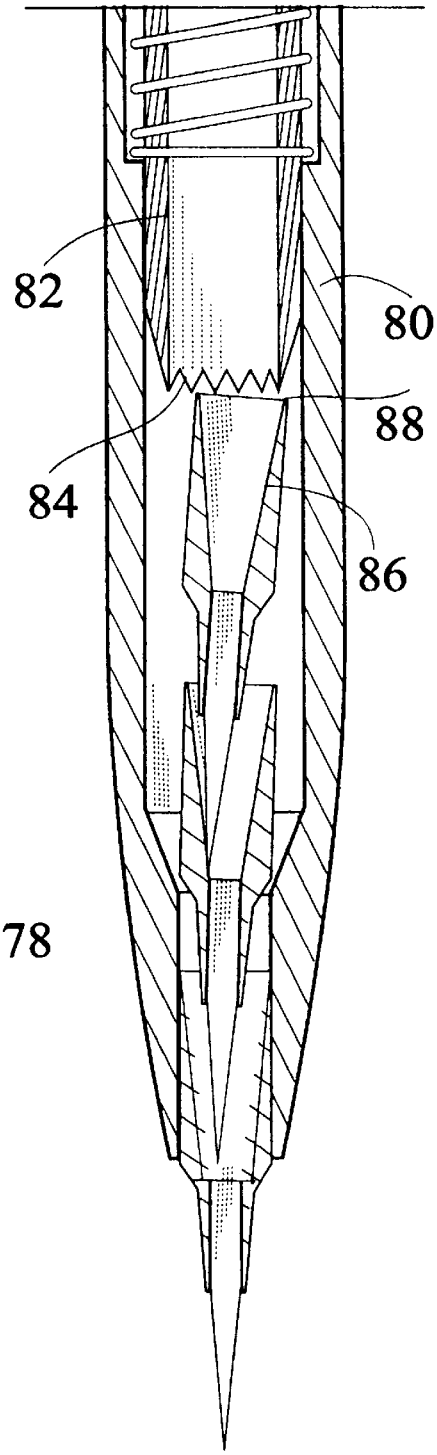
FIG. 16 illustrates the engagement between the writing element and the inner tube according to the present invention.

FIG. 16 shows the engagement between the lower opening 84 of the inner tube 82 and the element cap 88 of the writing element 86. The lower opening 84 of the inner tube 82 has a saw-toothed rim to make a proper engagement. For the same purpose, the rim of the element cap 88 is sharpened. Furthermore, the writing element 86 is slightly inclined to the wall of the outer tube 80 because of gravity. Such a situation can make a better engagement between the inner tube 82 and the writing element 86.

Figure 17:
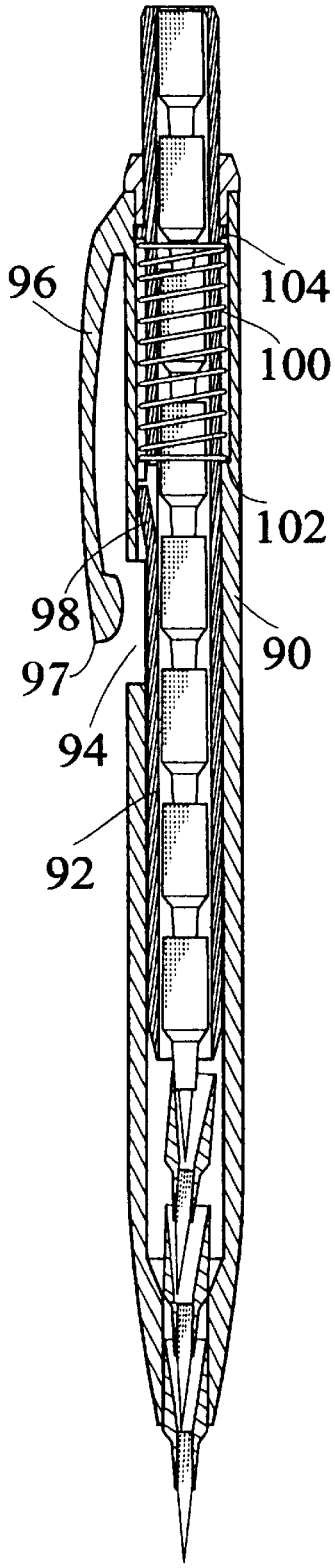
FIG. 17 shows another embodiment of the automatic capped writing element pencil according to the present invention.

The spring for urging the inner tube may be posited under or above the opening of the outer tube. FIG. 17 illustrates an example of positing the spring above the opening. An opening 94 is formed on the casing tube 90 opposite to the tip portion 97 of the clip 96. A flexible piece 98 is formed on the inner tube 92. A recess 102 is formed on the inner wall of the casing tube 90 for receiving the spring 100. The recess 102 is located above the opening 94. A raised portion 104 of the inner tube 92 is formed above the spring 100 to compress it.

Figure 18:
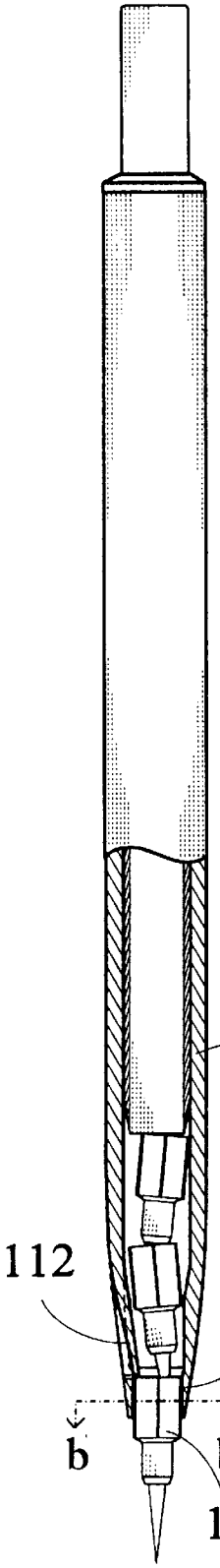
FIG. 18 illustrates an automatic capped writing element pencil having a writing element stopper according to the present invention.
Figure 19:
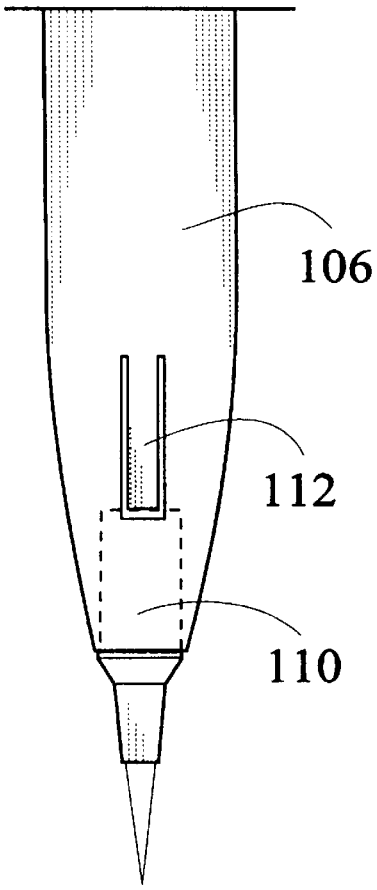
FIG. 19 illustrates the writing element stopper in FIG. 18.
Figure 20:
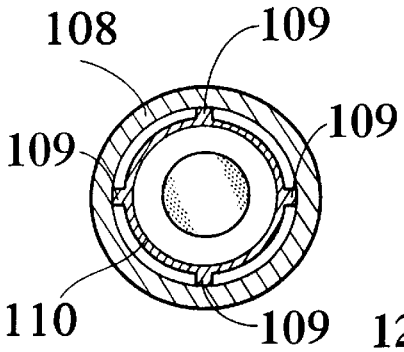
FIG. 20 is a cross sectional view of FIG. 18 along the line b–b1.

FIG. 18 illustrates a writing element stopper 112 formed near the writing element outlet 108 of the casing tube 106 to prevent the pen-tip writing element 110 from being pushed back into the writing element outlet 108. As shown in FIG. 19, the writing element stopper 112 is a flexible piece bearing against the end of the pen-tip writing element 110. Furthermore, as illustrated in FIG. 20, raised strips 109 are formed around the pen-tip writing element 110 to reduce a contact area between the pen-tip writing element 110 and the writing element outlet 108. Such a structure can prevent the pen-tip writing element 110 from being stuck at the writing element outlet 108.

Figure 21:
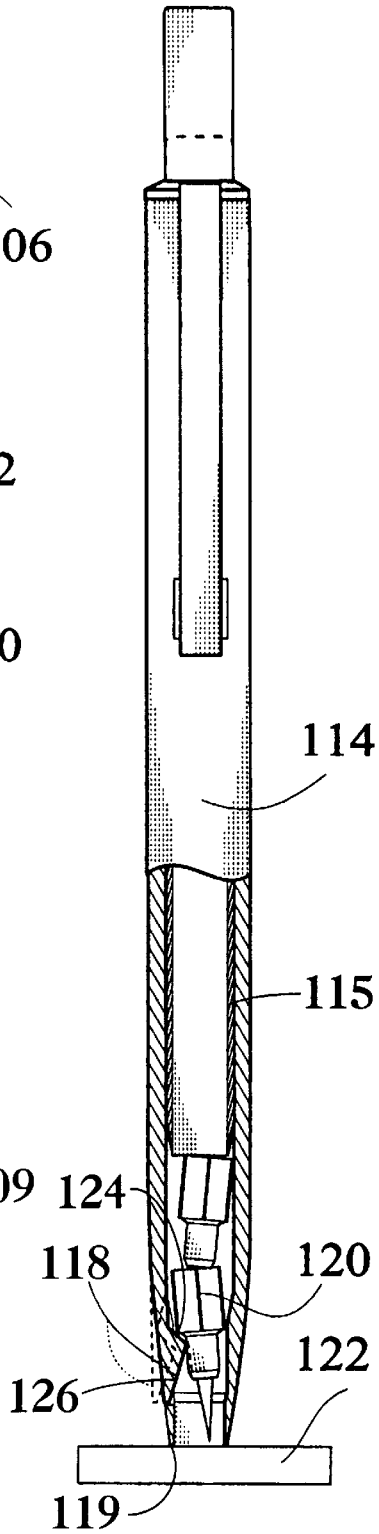
FIG. 21 illustrate an automatic capped writing element pencil with pen-tip writing element retracted within the casing tube and supported by a raised structure according to the present invention.

However, for an automatic writing element writing apparatus with retractable pen-tip writing element, a structure for maintaining the pen-tip writing element within the casing tube is needed while the pen-tip writing element is retracted. As shown in FIG. 21, the pen-tip writing element 120 is pushed by the article 122 to be retracted within the casing tube 114. When the casing tube 114 is removed from the surface of the article 122, the pen-tip writing element 120 will not fall down because it is supported by the raised structure 118. The raised structure 118 is a flexible piece integrally formed on the wall of the casing tube 114. It is also formed near the writing element outlet 119. The raised structure 118 has inclined surfaces 124 and 126 facing the inner tube 115 and the writing element outlet 119 respectively. Accordingly, the raised structure 118 is pushed away when the pen-tip writing element 120 is propelled toward the writing element-outlet 119 or pushed by the article 122.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic writing apparatus, comprising:

a plurality of writing elements generally axially positioned one by one, each of which has a writing tip portion and an element cap having a hole for receiving therein the tip portion of an adjacent one of said each element;

an outer tube for receiving therein first and second ones of said writing elements, wherein said outer tube includes a pen-tip outlet for receiving therein said first one of said writing elements; and an inner tube slidably received in the outer tube and receiving therein the others of said writing elements and having an end opening having a fixed radius for propelling said second one of said writing elements toward said pen-tip outlet for replacing said first one of said writing elements.

2. An apparatus according to claim 1 wherein said end opening of said inner tube engages with said element cap of said second one of said writing elements and allows a third one of said writing elements to fall into said outer tube from said inner tube.

3. An apparatus according to claim 2 wherein said element cap includes a sharpened rim for properly engaging with said end opening of said inner tube when being propelled.

4. An apparatus according to claim 2 wherein said end opening includes a saw-toothed rim for properly engaging with said element cap of said second one of said writing elements when propelling said second one of said writing elements.

5. An apparatus according to claim 1 wherein an upper portion of said inner tube is exposed from said outer tube for being pressed by a user to propel said second one of said writing elements.

6. An apparatus according to claim 1, further comprising a resilient element for keeping said inner tube in an original position when said inner tube is not pressed.

7. An apparatus according to claim 6 wherein said resilient element is a spring sleeved on said inner tube.

8. An apparatus according to claim 6, further comprising a locking mechanism for maintaining said inner tube in a lower position when said second one of said writing elements has been propelled to replace said first one of said writing elements.

9. An apparatus according to claim 8 wherein said locking mechanism includes:

a flexible piece mounted on the outer wall of said inner tube; and an opening formed on said outer tube so that when said inner tube is in said lower position, said flexible piece is stuck at said opening for preventing said inner tube from being urged back by said resilient element to said original position.

10. An apparatus according to claim 9, further comprising a clip mounted on the outer tube, wherein said clip includes a raised portion facing said opening of said outer tube for pushing away said flexible piece from said opening when being pressed.

11. An apparatus according to claim 10, further comprising an article being against said tip portion of said second one of said writing elements when said flexible piece is pushed away from said opening so that said second one of said writing elements is pushed back into said outer tube by said article to retract said second one of said writing elements.

12. An apparatus according to claim 11, further comprising a raised structure formed on the inner wall of said outer tube for maintaining said tip portion of said second one of said writing elements within said outer tube when being retracted.

13. An apparatus according to claim 9, further comprising a guiding slot formed on the inner wall of said outer tube for guiding said flexible piece to said opening.

14. An apparatus according to claim 13 wherein said guiding slot includes an enlarged entrance formed on a rear end of said outer tube.

15. An apparatus according to claim 1, further comprising a writing element stopper for preventing said first one of said writing element from being pushed into said outer tube.

16. An apparatus according to claim 15 wherein said writing element stopper is a flexible structure formed on the inner wall of said outer tube.

* * * * *